US008157108B1

(12) United States Patent
Waldrop

(10) Patent No.: US 8,157,108 B1
(45) Date of Patent: Apr. 17, 2012

(54) PULL-OUT, DROP-DOWN CLOSET STORAGE SYSTEM

(76) Inventor: John E. Waldrop, Lexington, KY (US)

( * ) Notice: Subject to any disclaimer, the term of this patent is extended or adjusted under 35 U.S.C. 154(b) by 552 days.

(21) Appl. No.: 12/229,849

(22) Filed: Aug. 27, 2008

(51) Int. Cl.
*A47F 5/025* (2006.01)
*A47F 5/00* (2006.01)
*A47B 46/00* (2006.01)

(52) U.S. Cl. ..... 211/1.57; 211/134; 312/247; 108/20

(58) Field of Classification Search ..... 211/1.51, 211/1.57, 26, 90.02, 94.02, 113, 117, 119.003, 211/126.15, 134, 151, 162, 175, 209, 208, 211/207, 94.01; 312/319.5, 319.6, 319.7, 312/319.8, 247, 246, 312, 301, 298; 108/20, 108/143, 147.11
See application file for complete search history.

(56) References Cited

U.S. PATENT DOCUMENTS 447,658 A * 3/1891 Brockmann ..... 211/162
617,965 A * 1/1899 Lippincott et al. ..... 108/102
749,653 A * 1/1904 Arnold ..... 312/266
973,573 A * 10/1910 Sims ..... 312/31.2
2,435,755 A * 2/1948 Schimpff ..... 186/53
2,499,791 A * 3/1950 Spencer ..... 312/247
2,555,254 A * 5/1951 Stebbins ..... 312/319.7
2,634,186 A * 4/1953 Zuss ..... 312/201
2,915,192 A * 12/1959 Roma, Jr. ..... 108/42
3,627,397 A * 12/1971 Rominsky ..... 312/246
3,730,358 A * 5/1973 Oji ..... 211/1.57
3,734,588 A * 5/1973 Ellis ..... 312/247
3,973,504 A * 8/1976 Knudsen ..... 104/172.4
4,915,461 A * 4/1990 Kingsborough et al. ..... 312/247
5,203,619 A 4/1993 Welsch et al.
5,211,461 A 5/1993 Teufel et al.
5,249,858 A * 10/1993 Nusser ..... 312/319.6
5,303,997 A 4/1994 Kropf
5,535,852 A * 7/1996 Bishop et al. ..... 187/336
5,582,306 A 12/1996 Balter et al.
5,605,238 A 2/1997 Jacobs
5,758,782 A * 6/1998 Rupert ..... 211/99
5,819,958 A 10/1998 Dement
6,079,803 A 6/2000 West et al.
6,241,048 B1 6/2001 Heilmann
6,250,728 B1 6/2001 Thorp
6,484,893 B1 * 11/2002 Tkatch ..... 211/94.02
6,851,376 B2 2/2005 D'Agostino
2006/0066188 A1 * 3/2006 Crawford ..... 312/247

FOREIGN PATENT DOCUMENTS

WO WO 9417693 A1 * 8/1994

* cited by examiner

*Primary Examiner* — Darnell Jayne
*Assistant Examiner* — Stanton L Krycinski
(74) *Attorney, Agent, or Firm* — Montgomery Patent & Design, LLC; Robert C. Montgomery; Joseph T. Yaksich

(57) ABSTRACT

A motorized pull-out, drop-down, closet storage shelf system is herein disclosed. The shelf system provides a track system and a series of roller slides which propel a shelf forward and downward from its conventional stowed position to a lowered position by simply pressing a button. The access position allows comfortable access for someone sitting in a wheelchair, for a child, or for someone unable to reach the shelf without assistance. The shelf system is capable of transporting heavy loads of up to fifty (50) pounds. When shelf access is complete, the motorized mechanism returns the shelf to its original position.

17 Claims, 5 Drawing Sheets

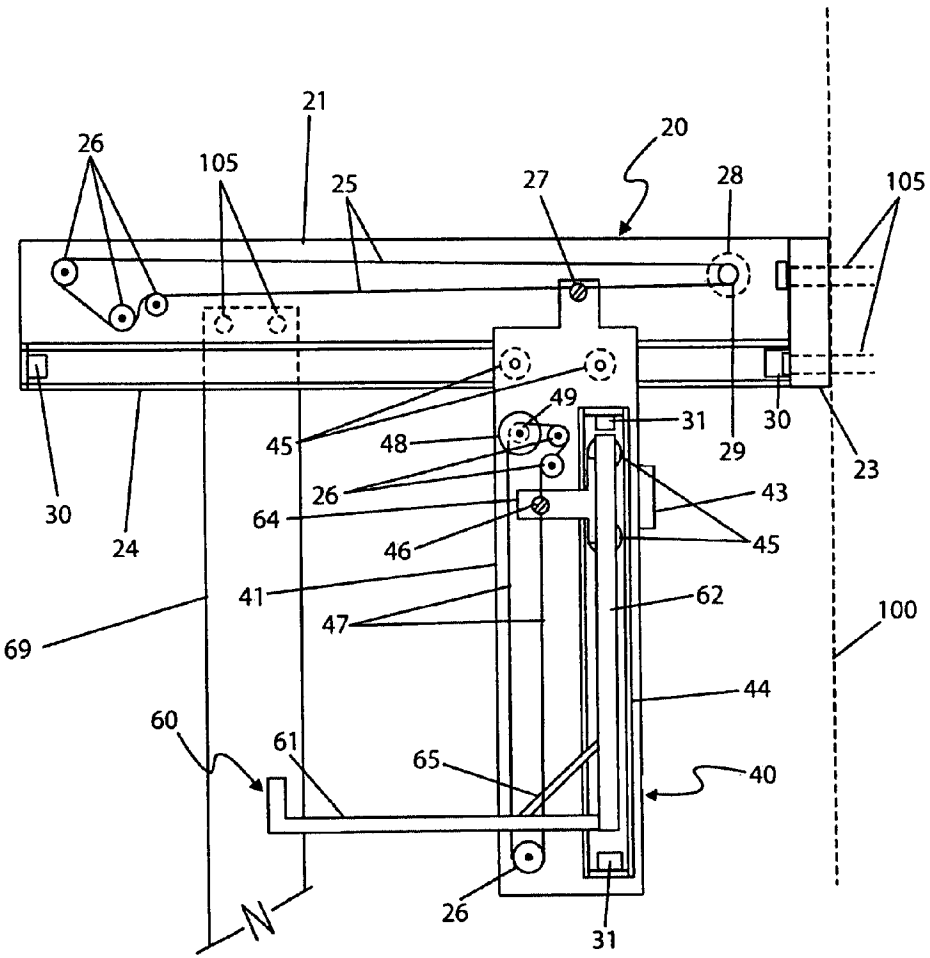
Fig. 4
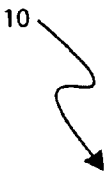

PULL-OUT, DROP-DOWN CLOSET STORAGE SYSTEM

FIELD OF THE INVENTION

The present invention relates generally to a closet shelf apparatus and, more particularly, to said apparatus comprising two (2) cable drive mechanisms that allow the shelf to be pulled out and down for ease of access.

BACKGROUND OF THE INVENTION

People with physical challenges including, such as the elderly, the handicapped, people of short stature, wheelchaired individuals and those recovering from injuries or surgery know the difficulties encountered when accessing articles on a closet shelf of some height, especially a shelf situated above a clothing rod. Many of the aforementioned people find it difficult to reach important items on the shelves. For those confined to a wheelchair, obtaining anything off of a closet shelf becomes a virtually impossible task. Accordingly, there exists a need for a means by which physically challenged individuals, can be afforded the ability to access the contents of a closet. The development of the invention herein disclosed fulfills this need.

The invention is an apparatus that utilizes a novel pull-out, drop-down, spring-loaded closet storage shelf system. Although resembling a conventional closet storage shelf, the innovative system and apparatus provides for two (2) cable drive mechanisms and a plurality of supports that allows the shelf and an attached rod to pull out and down from a conventional stowed position. In the lowered position, access is comfortable for someone sitting in a wheelchair, for a child, or for someone unable to reach the shelf and/or the rod without assistance. A plurality of support rods and braces provide safe support for even the heaviest of loads. When shelf access is complete, a cable return mechanism allows the shelf to be simply returned back up to its original position.

Several attempts have been made in the past to provide systems for retractable storage units. U.S. Pat. No. 5,203,619, issued in the name of Welsch et al., describes a vertical retractable ceiling storage system comprising a frame and a retractable vertical lifting mechanism. However, unlike the present invention, the Welsch storage system is intended as a ceiling support structure which is retracted within and hidden behind the ceiling panel, thereby posing increased difficulties in retrofitting the system; additionally the system only provides vertical positioning to create increased floor space.

U.S. Pat. No. 5,211,461, issued in the name of Teufel et al., describes vertical adjustable extension drawers comprising two (2) adjustable extension rails, a plurality of horizontally-extending guide ribs for drawers, and a guide arm which mounts to a vertical surface. However, unlike the present invention, the Teufel drawers provides for a customizable drawer system with an extendable rail system for use with an outer housing which enables small vertical adjustments of the drawers.

U.S. Pat. No. 5,605,238, issued in the name of Jacobs, describes a shelving system comprising a plurality of support structures, shelf planks, fastening brackets, and fasteners which are mounted to a vertical wall surface and provides a modular and adjustable shelving system for closets. However, unlike the present invention, the Jacobs shelving system is merely a closet organizer and lacks the benefit of adjustable shelving space for the physically challenged.

U.S. Pat. No. 6,241,048, issued in the name of Heilmann, describes a storage and lift platform comprising a plurality of platforms, cables, frame members, and a drive axle which provides a means of vertically raising and lowering a single or plurality of platforms for long-term storage. However, unlike the present invention, the Heilmann lift platform only provides vertical adjustments and is intended for larger loads and longer term storage.

U.S. Pat. No. 6,851,376, issued in the name of D'Agostino, discloses a pull down shelf for overhead storage comprising a lower shelf, a pair of scissor-action stabilizers, and wind-up mechanism which enables a user to physically pull a ceiling mounted shelf down to a lower vertical position and then by releasing the wind-up mechanism raising the shelf back to its original position. However, unlike the present invention, the D'Agostino pull down shelf again only provides for vertical position adjustment and lacks the benefit of facilitating to a physically challenged person or a child.

The prior art appears to disclose a variety of retractable storage units. However, none of the prior art particularly describes a motorized shelving unit which provides for both horizontal and vertical position adjustment further providing a means of assisting in the accessing of stored items by a physically challenged person or child. Accordingly, there exists a need for a pull-out, drop-down closet storage system that operates without the disadvantages as described above.

SUMMARY OF THE INVENTION

In view of the foregoing disadvantages inherent in the prior art, it has been observed that there is need for a pull-out, drop-down closet storage system for providing a shelf storage system which assists in the accessing of stowed items by a physically challenged person, an elderly person, or a child.

To achieve the above objectives, it is an object of the present invention to provide a pull-out, drop-down closet storage system comprising a shelf assembly, a horizontal slide assembly, a vertical slide assembly, and a control module.

A further object of the present invention is to provide a shelf assembly comprising a vertical panel and a horizontal panel which form an "L"-shaped structure, a safety lip at the distal end of the horizontal panel, and a first and a second brace which provide a connection means all of which provide a secure storage shelf surface for a user to store items on.

Yet still another object of the present invention is to provide a horizontal slide assembly comprising a set of horizontal frames, a first cable drive mechanism, a wall mounting plate, a first set of rollers, and a horizontal roller channel.

Yet still another object of the present invention is to provide a wall mounting plate which provides a surface for attaching the system to a wall and a first and a second horizontal frame which attach to the mounting plate parallel to one another and to the floor and extend out perpendicularly from the wall surface.

Yet still another object of the present invention is to provide a first set of rollers which provide horizontal movement of the vertical slide assembly between the horizontal frames via a horizontal roller channel located on the inside of the horizontal frames which provide a linear guide to the horizontal rollers.

Yet still another object of the present invention is to provide a first cable drive mechanism comprising a first motor attached to the first horizontal frame which provides the means of horizontal linear movement to the vertical slide assembly via mechanical interaction between the motor and a horizontal cable, a first drive pulley and a plurality of horizontal idler pulleys.

Yet still another object of the present invention is to provide a vertical slide assembly comprising a set of vertical frames, a second cable drive mechanism, a second set of rollers, and a vertical roller channel.

Yet still another object of the present invention is to provide a second set of rollers which provide vertical movement of the shelf assembly between the vertical frames via a vertical roller channel located on the inside of the vertical frames which provide a linear guide to the vertical rollers.

Yet still another object of the present invention is to provide a second cable drive mechanism comprising a second motor attached to the inner surface of the first vertical frame which provides the means of vertical linear movement to the shelf assembly via mechanical interaction between the motor and a vertical cable, a second drive pulley and a plurality of vertical idler pulleys.

Yet still another object of the present invention is to provide a first support leg and a second support leg each comprising a first foot portion and a second foot portion respectively which provide a means of attaching the system to the floor and providing a means of supporting the combined weight of the system and any stowed load.

Yet still another object of the present invention is to provide a control module comprising software logic functions and radio frequency (RF) reception and processing which provides intelligent motion control and electrical power distribution to the horizontal and vertical slide assemblies.

Yet still another object of the present invention is to provide a first and a second horizontal position switch located on opposite ends of the horizontal roller channel and provides horizontal position information of the vertical slide assembly to the control module.

Yet still another object of the present invention is to provide a first and a second vertical position switch located on opposite ends of the vertical roller channel and provides vertical position information of the shelf assembly to the control module.

Yet still another object of the present invention is to provide a wall mounted system activation switch which communicates with the control module and initiates the deployment of the system and the return to the stowed position.

Yet still another object of the present invention is to provide a portable remote control system activation switch which communicates with the control module via an RF signal and initiates the deployment of the system and the return to the stowed position.

Yet still another object of the present invention is to provide a shelf storage system comprising a normal stowed position and a deployed position which repositions the shelf assembly approximately sixteen (16) inches away from a wall surface in the horizontal direction and approximately thirty (30) inches in a vertical direction.

Yet still another object of the present invention is to provide a method for utilizing a pull-out, drop-down closet storage system.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 4 is a section view taken along section A-A (see FIG. 1) depicting cable drive portions of a pull-out, drop-down closet storage system 10, according to a preferred embodiment of the present invention; and, FIG. 5 is an electrical block diagram of a pull-out, drop-down closet storage system 10, according to a preferred embodiment of the present invention.

DESCRIPTIVE KEY

Figure 1:
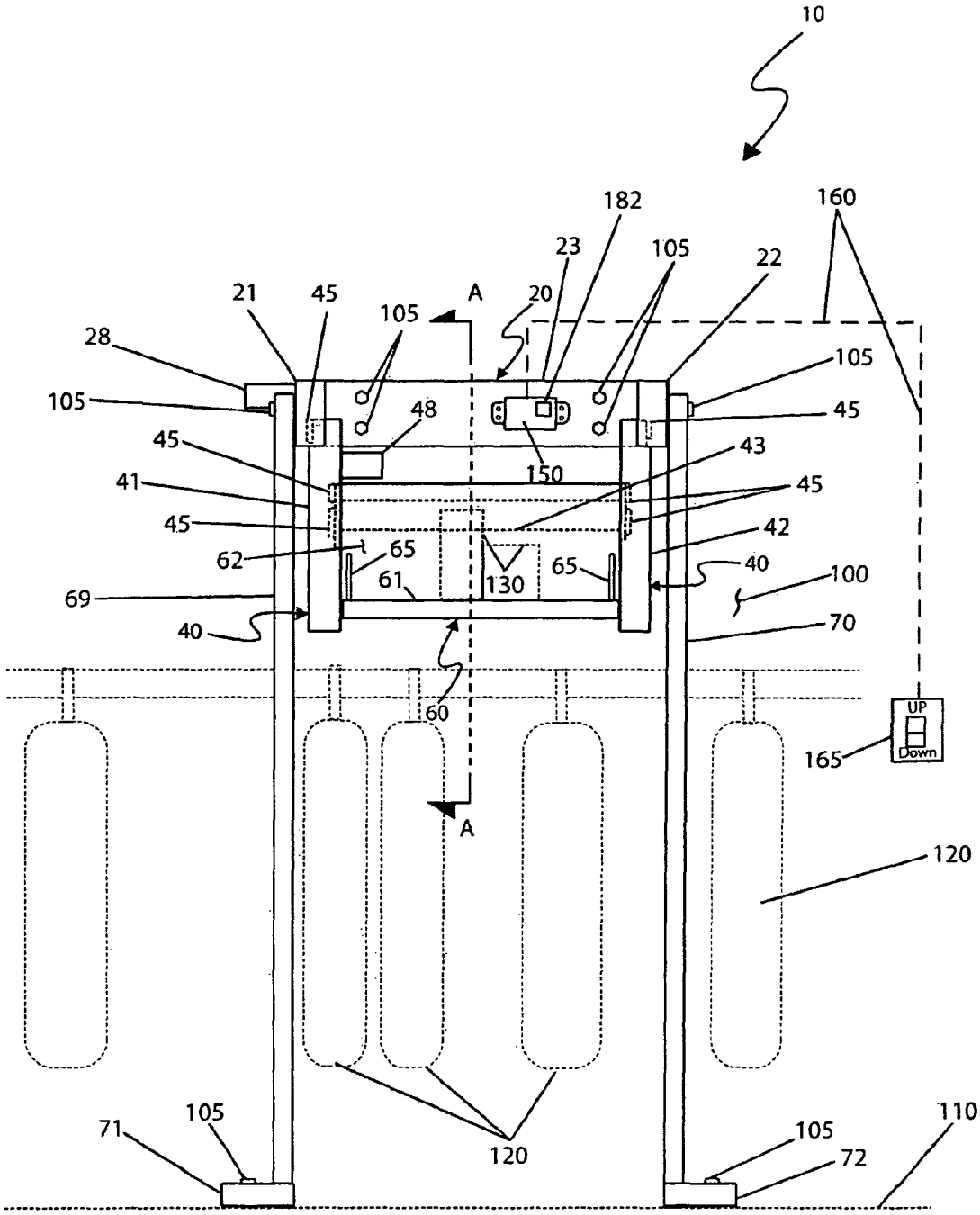
FIG. 1 is a front view of a pull-out, drop-down closet storage system 10 in an upward or stowed orientation installed therein a conventional closet, according to the preferred embodiment of the present invention.

| | |
|---|---|
| 10 | pull-out, drop-down closet storage system |
| 20 | horizontal slide assembly |
| 21 | first horizontal frame |
| 22 | second horizontal frame |
| 23 | wall mounting plate |
| 24 | horizontal roller channel |
| 25 | horizontal cable |
| 26 | idler pulley |
| 27 | horizontal cable attachment |
| 28 | first motor |
| 29 | first drive pulley |
| 30 | horizontal position switch |
| 31 | vertical position switch |
| 40 | vertical slide assembly |
| 41 | first vertical frame |
| 42 | second vertical frame |
| 43 | crossmember |
| 44 | vertical roller channel |
| 45 | roller |
| 46 | vertical cable attachment |
| 47 | vertical cable |
| 48 | second motor |
| 49 | second drive pulley |
| 60 | shelf assembly |
| 61 | shelf |
| 62 | vertical panel |
| 64 | shelf attachment bracket |
| 65 | brace |
| 66 | lip |
| 69 | first support leg |
| 70 | second support leg |
| 71 | first support foot |
| 72 | second support foot |
| 100 | wall surface |
| 105 | fastener |
| 110 | floor surface |
| 120 | clothes |
| 130 | load/stored item |
| 150 | control module |
| 155 | 110-volt power source |
| 160 | wiring |
| 165 | wall mounted switch |
| 180 | remote controller |
| 181 | radio frequency (RF) signal |
| 182 | antenna |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a pull-out, drop-down closet storage system (herein described as the "system") 10 and associated method of use, comprising a motorized means of lowering a closet shelf 61 therefrom a conventional upper location above hung clothing 120, thereto an easily accessed lower position activated by a wall mounted switch 165 or a hand-held remote controller 180. The system 10 utilizes two (2) cable drive mechanisms to smoothly extend and lower a loaded shelf 61 to a convenient height approximately thirty (30) inches above a floor surface 110. In the lowered position, access is comfortable for a seated user, someone sitting in a wheelchair, a child, or for someone unable to reach a high shelf without assistance.

Referring now to FIG. 1, a front view of the system 10 in the upward or stowed orientation installed therein a conventional closet, according to the preferred embodiment of the present invention, is disclosed. The system 10 comprises a horizontal slide assembly 20, a vertical slide assembly 40, a shelf assembly 60, a first support leg 69, a second support leg 70, and a control module 150. The system 10 is illustrated here installed therein a normal or walk-in closet being affixed thereto at an upper distal wall surface 100 and a proximal floor surface 110, thereby providing a rigid faming means thereto the system 10. The system 10 provides automatic positioning of a shelf 61 using side mounted motorized horizontal and vertical motion devices to conveniently present said shelf 61 thereto a user.

The horizontal slide assembly 20 provides an initial transportation of a loaded shelf 61 in a horizontal direction away from the wall surface 100 thereto a position forward of any existing shelves, hanging rods, and clothing 120. The vertical slide assembly 40 then provides a secondary vertical motion to lower said shelf 61 thereto a convenient access height (see FIGS. 2 and 3). The horizontal slide assembly 20 provides an attachment and motorized transport means thereto affixed vertical slide 40 and shelf 60 assembly portions by propelling said assemblies 40, 60 therefrom an upper distal position to an upward proximal position. The horizontal slide assembly 20 comprises a rugged structure being capable of supporting a weight of the attached assemblies 40, 60 as well as an expected load 130 of fifty (50) pounds thereupon the shelf assembly 60. The horizontal slide assembly 20 provides a "U"-shaped structure being formed or welded and further comprising a first horizontal frame 21, a second horizontal frame 22, and a wall mounting plate 23. The mounting plate 23 and horizontal frame portions 21, 22 preferably comprise heavy-duty extruded or stamped steel members. The wall mounting plate 23 a width of the system 10 being approximately six (6) to eight (8) inches high providing an attachment means thereto the wall surface 100 using a plurality of common fasteners 105 such as wall anchors, lag screws, or the like being securely mounted to wooden framing members within the wall surface 100. The wall mounting plate 23 provides a formed or welded attachment thereto the horizontal frame portions 21, 22 which extend perpendicularly therefrom, being arranged in a parallel fashion thereto one another and parallel to a closet floor surface 110. The horizontal frame portions 21, 22 provide a guided transport thereto affixed vertical slide 40 and shelf 60 assemblies using respective pairs of rollers 45 supporting a central load 130 in a parallel manner. The horizontal frame portions 21, 22 provide a parallel load bearing function envisioned being similar thereto common drawer roller-slide hardware. The horizontal slide assembly 20 comprises a single-sided horizontal cable 25 (see FIG. 4) driven means via a motor 28 and associated drive components affixed thereto an inner surface of the first horizontal frame portion 21 while the second horizontal frame 22 provides a non-motorized guiding means thereto the horizontal slide assembly 20 when in motion. The rollers 45 and cable drive portions 25 of the horizontal slide assembly 20 provide an attachment means thereto the vertical slide assembly 40. The horizontal slide assembly 20 provides an attachment means thereto a first vertical support leg 69 and a second support leg 70 affixed along outward surfaces of the first 21 and second 22 horizontal frame portions using common fasteners 105 and located approximately two (2) feet from the wall surface 100 extending vertically downward to a floor surface 110. The support legs 69, 70 preferably comprise sturdy rectangular tubing capable of supporting a combined weight of the system 10 and an applied load 130 placed thereupon when in use. The legs 69, 70 further comprise a first foot portion 71 and a second foot portion 72 comprising welded or fastened rectangular structures extending along the floor surface 110 therefrom said legs 69, 70 in a perpendicular fashion being approximately three (3) inches square being affixed thereto said floor surface 110 using common fasteners 105.

The vertical slide assembly 40 further comprises a first vertical frame 41, a second vertical frame 42, and a crossmember 43. The vertical slide assembly 40 extends downwardly therefrom the horizontal slide assembly 20 providing a vertical transport means thereto the affixed shelf assembly 60. The vertical slide assembly 40 provides a roller 45 guided, single-sided motor 48 driven assembly in a similar fashion as the aforementioned horizontal slide assembly 20 using similar materials and methods of construction. The crossmember 43 provides a lateral strengthening and stiffening means therebetween the first vertical frame 41 and second vertical frame portions 42. The crossmember 43 comprises a rectangular structural member extending therebetween said first vertical frame 41 and second vertical frame 42 along a rearward vertical edge being fastened thereto using a welding process or common fasteners 105. The shelf assembly 60 provides a stable horizontal surface on which a user may store garments, clothing, shoes, or other personal stored items 130 in an expected manner. The shelf assembly 60 is illustrated here being in a retracted and stowed state directly above an existing closet shelf; however, it is understood that the shelf assembly 60 may be installed in such a way as to replace all or a section of said existing closet shelf with equal benefit.

Figure 5:
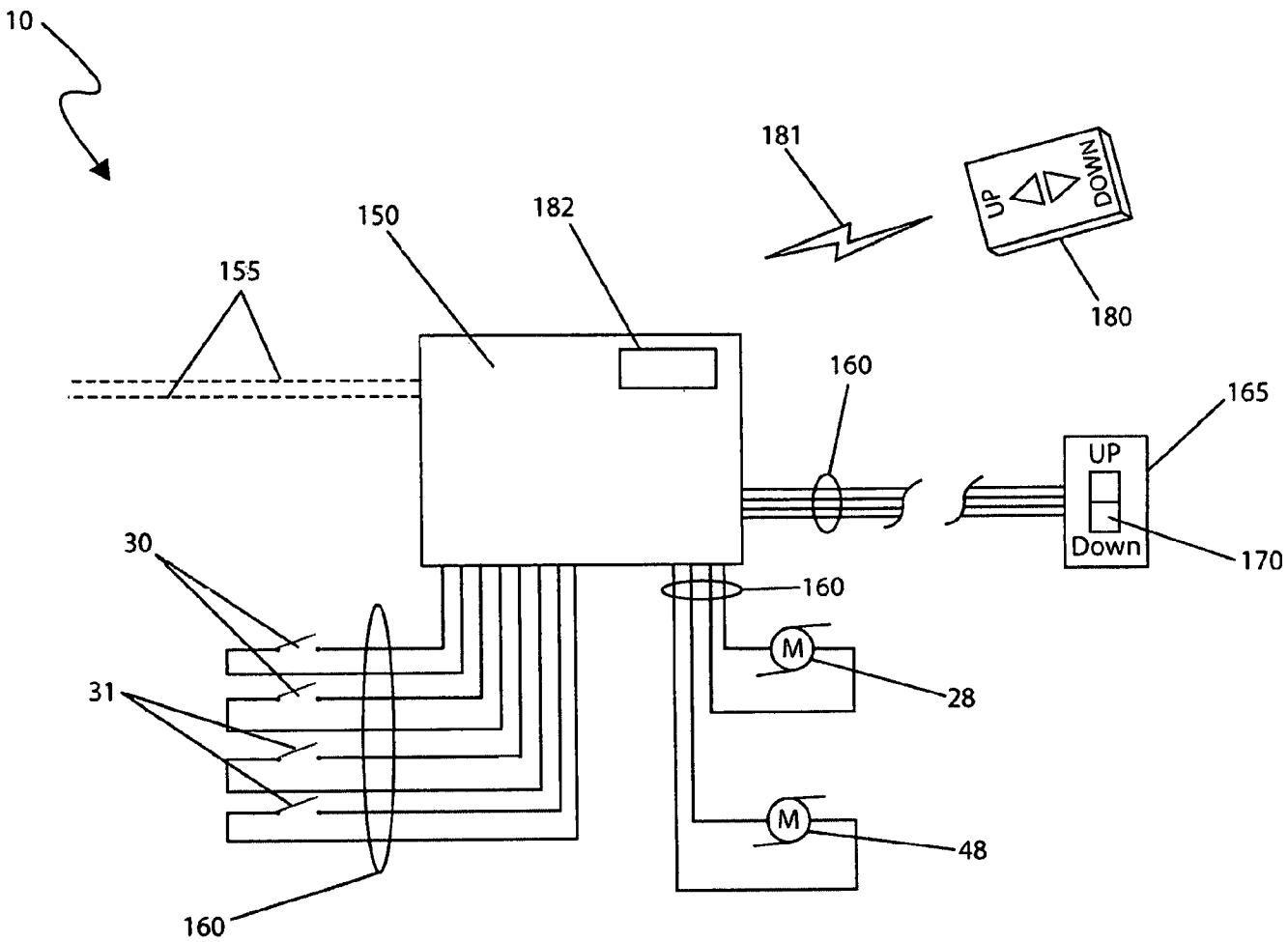

The control module 150 is located centrally along a front surface of the wall mounting plate 23 comprising a rectangular plastic housing providing a protective enclosure thereto internal electrical and electronic equipment (see FIG. 5).

The horizontal 20 and vertical 40 slide assembly portions of the system 10 are envisioned being preferably made using extruded or stamped steel members; however other materials may be provided such as plastics, aluminum, synthetic material, and/or any other sturdy lightweight materials.

The system 10 is envisioned being utilized therein closet areas but may also be utilized to allow items to be stored within an inside room of households, hotels, schools, hospitals, industrial areas and the like. Further, the system 10 may be utilized using an attachment thereto overhead joists of a closet, basement, garage, and/or other areas which have limited or inaccessible spaces.

Figure 2:
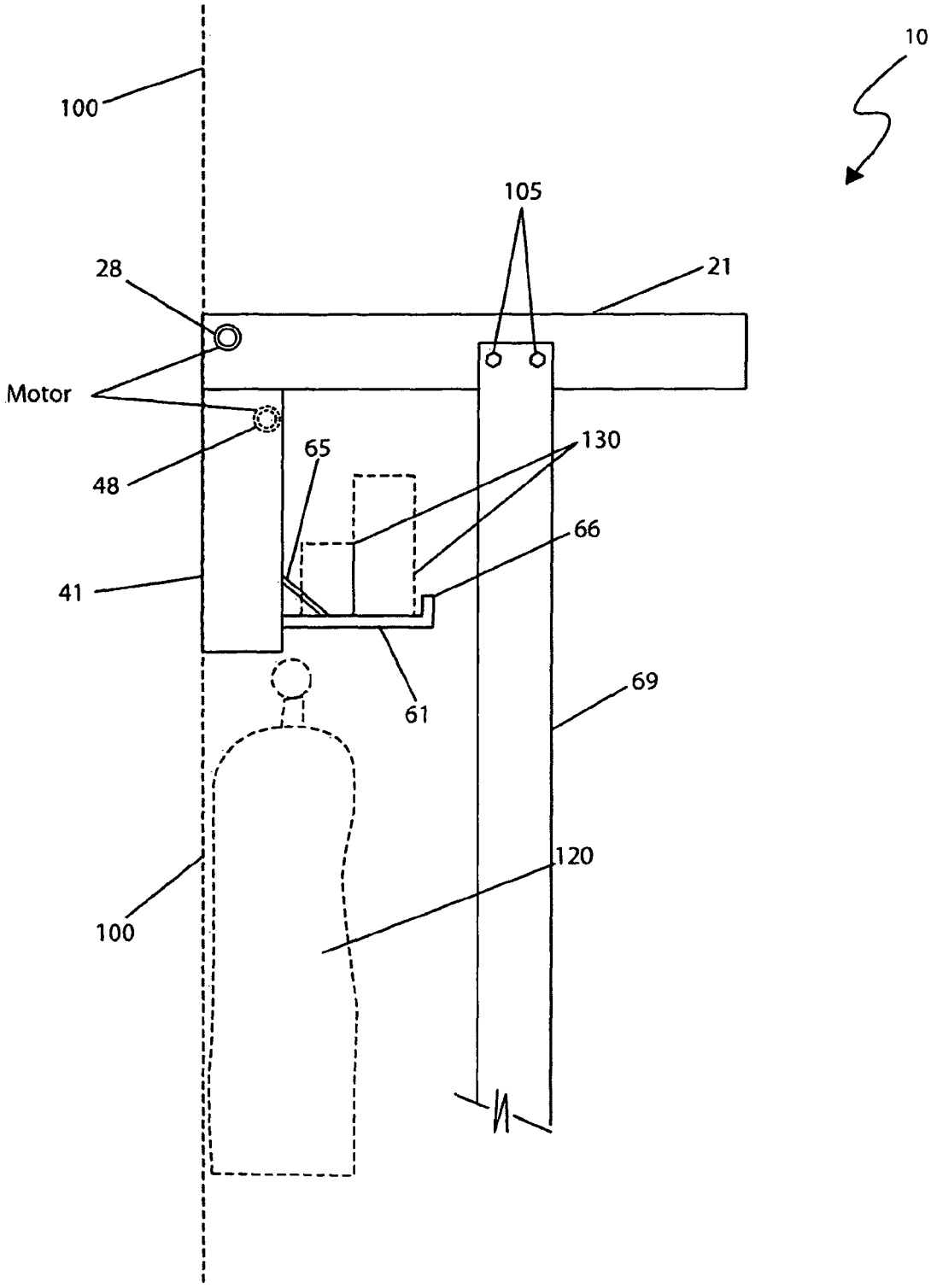
FIG. 2 is a side view of a pull-out, drop-down closet storage system 10 in the upward or stowed orientation, according to a preferred embodiment of the present invention.
Figure 3:
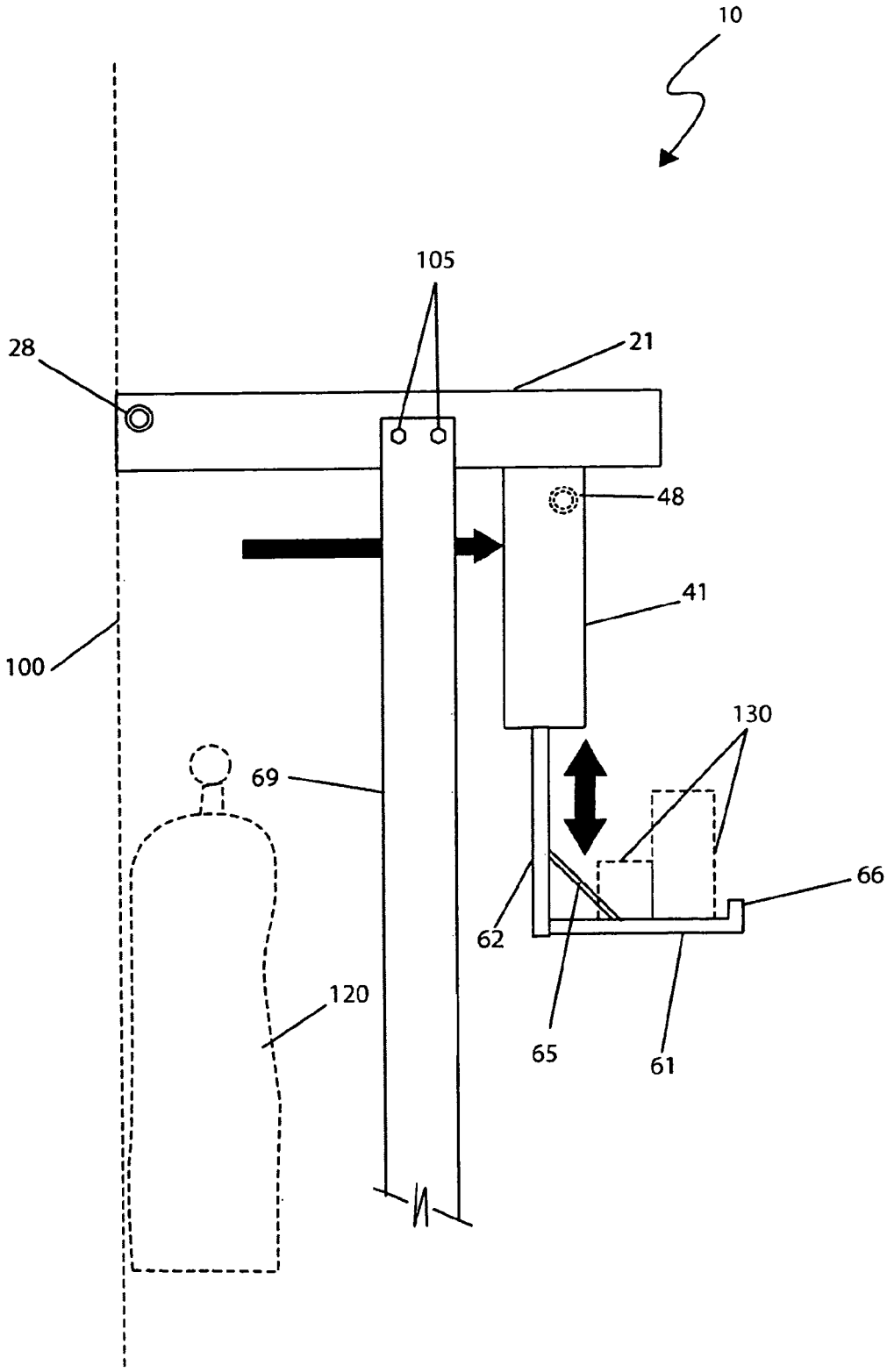
FIG. 3 is a side view of a pull-out, drop-down closet storage system 10 in a lowered access orientation, according to a preferred embodiment of the present invention.

Referring now to FIGS. 2 and 3, side views of the system 10 depicting stowed and lowered access orientations, according to a preferred embodiment of the present invention, is disclosed. The system 10 comprises a first horizontal frame 21, a first vertical frame 41, and a shelf 61. During use, an operator activates the system 10 via a wall mounted switch 165, or via a remote control 180, which in turn begins a sequential motion, thereby repositioning the shelf 61 from a stowed orientation (see FIG. 2) thereto an extended and lowered access orientation (see FIG. 3). An initial horizontal motion moves the shelf 61 forward approximately sixteen (16) inches being powered by a first motor 28. Subsequently, a downward vertical movement powered by a second motor 48 positions said shelf 61 approximately thirty (30) inches above a floor surface 110 as shown in FIG. 3, thereby allowing easy access thereto a contained load 130 by a child or seated adult.

FIG. 4 is a section view taken along section A-A (see FIG. 1) depicting cable drive portions of the system 10, according to the preferred embodiment of the present invention, is disclosed. The system 10 is illustrated here showing a single motorized side only for clarity. The system 10 comprises a first horizontal frame 21 and a first vertical frame 41 being designed to work in conjunction therewith the corresponding non-driven mirror-image second horizontal frame 22 and second vertical frame 41 portions, respectively, being located along an opposing side of the system 10 (see FIG. 1).

The first horizontal frame 21 further comprises a horizontal roller channel 24, a horizontal cable 25, a plurality of idler pulleys 26, a horizontal cable attachment 27, a first motor 28, a first drive pulley 29, and a pair of horizontal position switches 30. The horizontal roller channel 24 provides a captivating linear guide thereto a pair of rollers 45 being arranged approximately four (4) inches apart. The rollers 45 provide a guided attachment therebetween the first horizontal frame 21 and the first vertical frame 41. The rollers 45 comprise common ball-bearing roller devices approximately one (1) to two (2) inch in diameter with integral threaded axles, each being threadingly affixed thereto the first vertical frame 41 via drilled holes and common fasteners 105. The horizontal roller channel 24 also comprises a pair of horizontal position switches 30 being located thereat each extreme end portion. The horizontal position switches 30 provide information thereto the control module 150 pertaining to a position of the first vertical frame 41 during deployment or stowage of the system 10. The horizontal position switches 30 are located exclusively thereupon the motor driven first horizontal frame 21. The horizontal position switches 30 preferably comprise lever type micro-switches being common in the industry. The first motor 28 comprises a common sealed 110-volt AC reversing motor with integral gear reduction and single output shaft being similar to those found in common drill motors. The first motor 28 provides a two-directional drive means thereto the cable 25 via a first drive pulley 29 mounted thereto the output shaft portion of the motor 28. The cable 25 provides a driving attachment means therebetween the first horizontal frame 21 and the first vertical frame 41. The cable 25 comprises a length of common stainless steel wire rope forming a continuous loop having a lower taught length positioned parallel thereto the aforementioned horizontal roller channel 24. The cable 25 is envisioned being a durable braided wire rope preferably, but not essentially comprising a plastic friction sleeve and having a diameter of approximately one-sixteenth (1/16) to one-eighth (1/8) inch. The cable loop 25 is routed therearound a plurality of free-spinning idler pulleys 26 providing a positioning and tensioning means thereto. The cable 25 provides transmission of a linear force thereto the first vertical frame 41 via a horizontal cable attachment 27. The horizontal cable attachment 27 comprises preferably, but not essentially a common cable holding bolt device similar to those used on bicycle braking systems.

The rollers 45 and the horizontal cable attachment 27 provide a means of guided and driven attachment therebetween the first horizontal frame 21 and the first vertical frame 41. The first vertical frame 41 is in mechanical cooperation therewith the shelf assembly 60 in a similar manner as the aforementioned first horizontal frame 21 and first vertical frame 41. The first vertical frame 41 provides a vertical guiding and driving means thereto the shelf assembly 60 comprising a vertical roller channel 44, a pair of vertical position switches 31, a vertical cable attachment 46, a vertical cable 47, a second motor 48, a plurality of idler pulleys 26, and a second drive pulley 49. Attachment therebetween the first vertical frame 41 and the shelf assembly 60 is accomplished by the second cable attachment 46 and a pair of rollers 45 as shown. The rollers 45 are arranged approximately four (4) inches apart being captivated therein the vertical roller channel 44, thereby providing secure vertical travel of the shelf assembly 60 regardless of offset forces resulting from a load 130 applied thereto the shelf 61. The second cable attachment 46 provides an attachment means thereto a shelf attachment bracket portion 64 of the shelf assembly 60 in a similar manner as the aforementioned horizontal cable attachment 27.

The shelf assembly 60 further comprises a shelf 61, a vertical panel 62, a pair of braces 65 (only one shown here), and a safety lip 66. The shelf assembly 60 is envisioned being made of sturdy wood or metal components capable of supporting a load of fifty (50) pounds being applied thereto the shelf portion 61. The shelf attachment bracket 64 comprises a "T"-shaped stamped or machined metal fixture being mounted securely thereto a forward surface of the vertical panel 62 along opposite side edges using common fasteners 105. The shelf assembly 60 provides a storage surface thereto a load 130 comprising shoes, boxes, personal items, and the like. The shelf 61 and vertical panel 62 comprise rectangular flat panels approximately one (1) inch thick being joined along a rear lower edge forming an "L"-shaped structure. The shelf 61 also comprises a safety lip 66 approximately one (1) inch high extending across a forward edge region to avoid possible shifting of said load 130 therefrom the shelf 61 during movement. The braces 65 provide a common angular connection therebetween the shelf 61 and vertical panel 62 being in a state of tension and providing a strengthening means thereto the shelf assembly 60. The shelf assembly 60 is assembled using common fasteners 105 such as screws, bolts, or the like.

Referring now to FIG. 5, an electrical block diagram of the system 10, according to the preferred embodiment of the present invention, is disclosed. The system 10 comprises a control module 150, a pair of horizontal position switches 30, a pair of vertical position switches 31, a first motor 28, a second motor 48, a wall-mounted switch 165, a remote controller 180, an antenna 182, and interconnecting wiring 160. Electrical power is provided thereto the system 10 via a 110-volt power source 155 is hard-wired thereto the control module 150. The control module 150 provides intelligent motion control, electrical power distribution, radio frequency (RF) signal reception/processing, and software logic functions thereto the system 10. The control module 150 comprises a rectangular plastic housing providing a protective enclosure thereto internal electrical and electronic components and equipment such as circuit boards, relays, microprocessors, embedded software, an RF receiver, and the like. The control module 150 receives and processes commands therefrom the wall mounted switch 165 and the remote controller 180 to initiate upward and downward movements of the shelf assembly 60. The wall mounted switch 165 comprises a common self-contained panel-mounted device with included three (3) position rocker-type switch having a spring return center position. The remote controller 180 is envisioned being similar to common hand-held garage door opener units providing standard features such as a rectangular plastic housing, a battery compartment, batteries, an RF transmitter, and "UP" and "DOWN" digit operated buttons. The control module 150 further comprises a top mounted RF antenna 182 for receiving RF signals 181 emitted therefrom the remote controller 180. The control module 150 provides logic processing of received signals via embedded software and in turn energizes internal relays in a conventional manner, thereby sequentially directing a current thereto the first motor 28 and second motor 48 resulting in horizontal and vertical motions of the slide assemblies 20, 40, respectively. Motion control signals are also conducted thereto the control module 150 via common copper conductors 160 therefrom the position switches 30, 31 which detect a travel limit for the horizontal 20 and vertical 40 slide assemblies, respectively. Upon obtaining a travel limit signal therefrom a position switch 30, the control module 150 halts an appropriate motor 28, 48, thereby preventing overcurrent damage from occurring.

In operation, a user presses either an "UP" or "DOWN" button portion of the wall-mounted switch 165 or remote controller 180; a continuous current is then conducted thereto the motors 28, 48 in a sequential fashion; an input signal is conducted therefrom a position switch 30, 31 indicating that a limit of travel has occurred and an appropriate motor 28, 48 is halted; the user releases the "UP" or "DOWN" button portion of the wall-mounted switch 165 or remote controller 180, thereby halting the system 10 in its current position.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1 and utilized as indicated in FIGS. 2 and 3.

The method of installing and utilizing the system 10 may be achieved by performing the following steps: assembling the horizontal and vertical slide assemblies 20, 40 into a single unit, if not previously assembled; assembling the shelf assembly 60 thereto the vertical slide assembly 40 using provided common fasteners 105, if not previously assembled; assembling the first 69 and second 70 support legs thereto the first 21 and second 22 horizontal frames such that the first 71 and second 72 support feet rest thereupon a floor surface 110; fastening the system 10 to a rearward wall surface 100 using provided fasteners 105; fastening the system 10 to a floor surface 110 using provided fasteners 105; installing a fresh set of batteries therewithin the remote controller 180; installing the wall-mounted switch 165 along a wall surface 100 at a safe distance therefrom the system 10; routing wiring 160 within a wall 100 or discreetly along exterior surfaces of said wall 100 thereto the wall-mounted switch 165; connecting an existing 110-volt power source 155 thereto the control module 150; energizing the 110-volt power source 155; moving the shelf assembly 60 thereto the access position by pressing and holding the "DOWN" button on either the remote controller 180 or the wall-mounted switch 165 until a forward horizontal position switch 30 and subsequent lower vertical position switch 31 is activated causing a motion of the shelf 61 to cease in an access orientation; placing a load 130 of personal items such as shoes, boxes, or the like thereupon the shelf 61 as desired; pressing and holding the "UP" button either on the remote controller 180 or the wall-mounted switch 165 until an upper vertical position switch 31 is activated and a vertical motion ceases; allowing the shelf assembly 60 to proceed in a rearward direction until a rearward horizontal switch 30 is activated and motion ceases; releasing said "UP" button; and benefiting from increased safety, improved access, and effortless storage of personal items 130 using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A closet storage system comprising:

a wall mounting plate attachable to a wall surface;

a first horizontal frame perpendicularly affixed to said wall mounting plate parallel to a floor surface;

a first support leg comprising an upper end attached to said first horizontal frame and a lower end having a first support foot attachable to a floor surface;

a second horizontal frame perpendicularly affixed to said wall mounting plate parallel to said floor surface and aligned with said first horizontal frame;

a second support leg comprising an upper end attached to said second horizontal frame and a lower end having a second support foot attachable to said floor surface; and, a horizontal roller channel attached to an interior side surface of said first horizontal frame;

a vertical slide assembly having a first set of rollers attached to an upper end opposite said horizontal roller channel and rotatably coupled to said horizontal roller channel;

a horizontal cable affixed to said vertical slide assembly by a horizontal cable attachment and routed completely around a first drive pulley and a plurality of horizontal idler pulleys attached to opposite ends of said interior side surface of said first horizontal frame;

a first motor attached to said first horizontal frame and in mechanical communication with said drive pulley for moving said vertical slide assembly in a horizontal direction; and, a shelf assembly moveably coupled to said vertical slide assembly to providing a stable horizontal surface that is vertically adjustable relative to said vertical slide assembly;

wherein said vertical slide assembly further comprises a first vertical frame connected to said first horizontal frame further comprising:

a second set of rollers providing vertical movement of said shelf assembly;

a vertical roller channel providing a linear guide to said second set of rollers;

a second motor affixed to an inner surface of said first vertical frame;

a vertical cable driven by said second motor by a second drive pulley and attached to a shelf attachment bracket by a vertical cable attachment;

a plurality of vertical idler pulleys wherein said vertical cable is routed therearound;

a second vertical frame connected to said second horizontal frame; and, a crossmember connected to said first vertical frame and said second vertical frame along a rearward vertical edge;

wherein said shelf assembly is moveable between a forward position and a rearward position and between a raised position and a lowered position relative to said wall mounting plate.

2. The system of claim 1, wherein said shelf assembly further comprises:

a vertical panel comprising said shelf attachment bracket connected thereto;

a shelf connected to a bottom surface of said vertical panel and forming an "L" shaped structure;

a safety lip located vertically upwards from an end of said shelf; and, a first brace and a second brace opposite said first brace providing an angular connection between said shelf and said vertical panel;

wherein said shelf assembly provides a storage surface for a user to store items thereupon.

3. The system of claim 2, wherein said system further comprises a control module located centrally along a front surface of said wall mounting plate; wherein said control module provides intelligent motion control, electrical power distribution, radio frequency signal reception and processing, and software logic functions to said system.

4. The system of claim 3, wherein said horizontal roller channel further comprises:

a first horizontal position switch located at a first end; and, a second horizontal position switch located at a second end opposite said first end;

wherein said first horizontal switch and said second horizontal switch provide information to said control module pertaining to a position of said vertical slide assembly.

5. The system of claim 4, wherein said vertical roller channel further comprises:

a first vertical position switch located at a first end; and, a second vertical position switch located at a second end opposite said first end;

wherein said first vertical switch and said second vertical switch provide information to said control module pertaining to a position of said shelf assembly.

6. The system of claim 5, wherein said system is activated by a wall mounted switch.

7. The system of claim 5, wherein said system is activated by a remote control.

8. The system of claim 5, wherein said horizontal slide assembly moves said shelf assembly approximately sixteen inches in a horizontal direction.

9. The system of claim 5, wherein said vertical slide assembly moves said shelf assembly approximately thirty inches in a vertical direction.

10. The system of claim 5, wherein said horizontal slide assembly and said vertical slide assembly are made using extruded or stamped steel members.

11. The system of claim 5, wherein said crossmember provides a lateral strengthening and stiffening means between said first vertical frame and said second vertical frame.

12. The system of claim 5, wherein said wall mounting plate of said system is attached to said wall surface by a plurality of fasteners.

13. The system of claim 5, wherein said first set of rollers and said second set of rollers comprise ball-bearing roller devices each approximately one to two inches in diameter.

14. The system of claim 5, wherein said shelf is lowered to a height approximately thirty inches above a floor surface.

15. The system of claim 5, wherein each of said cables has a diameter of approximately one-sixteenth to one-eighth inch.

16. The system of claim 5, wherein electrical power is provided to said system by a one hundred-ten volt power source hard-wired to said control module.

17. The system of claim 5, wherein said first support leg and said second support leg each comprise rectangular tubing capable of supporting a combined weight of said system and an applied load placed upon said shelf assembly.

* * * * *